US009277785B2

(12) United States Patent
Doyle

(10) Patent No.: US 9,277,785 B2
(45) Date of Patent: Mar. 8, 2016

(54) BOOT FASTENING DEVICE

(71) Applicant: Michael Doyle, Falmouth, ME (US)

(72) Inventor: Michael Doyle, Falmouth, ME (US)

( * ) Notice: Subject to any disclaimer, the term of this patent is extended or adjusted under 35 U.S.C. 154(b) by 0 days.

(21) Appl. No.: 14/692,137

(22) Filed: Apr. 21, 2015

(65) Prior Publication Data

US 2015/0296924 A1 Oct. 22, 2015

Related U.S. Application Data

(60) Provisional application No. 61/982,483, filed on Apr. 22, 2014.

(51) Int. Cl.
*A43C 11/14* (2006.01)
*A43B 1/00* (2006.01)

(52) U.S. Cl.
CPC ..... *A43C 11/144* (2013.01); *A43B 1/0054* (2013.01); *Y10T 24/2183* (2015.01)

(58) Field of Classification Search
CPC ..... Y10T 24/2183; Y10T 24/2106; Y10T 24/216; Y10T 24/2142; A43C 11/1406; A43C 11/1413; A43C 11/00; A43C 11/1433; A43C 11/144; A43C 11/146; A43C 11/1473; A43C 11/148; A43B 1/0072; A43B 5/0427
USPC .... 24/68 SK, 70 SK, 69 SK, 71 SK; 36/50.5, 36/118.3, 118.4, 118.5, 54
See application file for complete search history.

(56) References Cited

U.S. PATENT DOCUMENTS

| | | | | | |
|---|---|---|---|---|---|
| 2,691,314 | A * | 10/1954 | Stevens | B23P 19/065 | 81/470 |
| 4,541,147 | A * | 9/1985 | Olivieri | A43C 11/1406 | 24/68 SK |
| 4,667,424 | A * | 5/1987 | Sartor | A43B 5/0458 | 36/118.5 |
| 5,222,756 | A * | 6/1993 | Gorza | A63C 9/005 | 280/616 |
| 5,383,258 | A * | 1/1995 | Nicoletti | A43C 11/1406 | 24/68 SK |
| 5,386,650 | A * | 2/1995 | Storz | A43B 5/0427 | 36/118.3 |
| 5,745,963 | A * | 5/1998 | Graziano | A43B 1/0072 | 24/68 SK |
| 2008/0189922 | A1 * | 8/2008 | Marechal | A43C 11/1433 | 24/68 SK |

* cited by examiner

*Primary Examiner* — Robert J Sandy
*Assistant Examiner* — David Upchurch
(74) *Attorney, Agent, or Firm* — Patricia Mathers; Jeffrey Joyce

(57) ABSTRACT

A fastening device for ski boots. The device has a control means, an adjustment means and a strap assembly. The control means is operatable by a user and drives the adjustment means, which is coupled to the strap assembly. The adjustment means includes a gear set and a threaded rod, which allows for a very fine adjustment of the strap assembly and as a result a very fine adjustment of the fit of the boot on a skier's foot. Magnets may also be provided in the control means in a manner that allows the control means to maintain its position.

3 Claims, 8 Drawing Sheets

BOOT FASTENING DEVICE

BACKGROUND INFORMATION

1. Field of the Invention

The invention relates to the field of boot fasteners. More particularly, the invention relates to a mechanism that fastens a ski boot.

2. Discussion of the Prior Art

Ski boots have been known for a considerable amount of time. The conventional ski boot has an opening along one side of the boot, to facilitate getting a foot into or out of the boot, and a strap assembly that connects both sides of the opening and allows the user to adjust the fit of the boot against the user's leg. The proper and precise fit of a ski boot is especially important in the act of skiing as the boot is the skiers connection to the ski and thus allows the user to control the direction of the ski and in turn the direction of the skier. The better the boot fits, the better the skier's control over his or her actions. The common buckle uses a simple latching mechanism to secure the boot, thereby providing limited precision as to how the boot fits on the skier's foot.

What is needed is a fastening device that provides for a fine adjustment and that is easily operated.

BRIEF SUMMARY OF THE INVENTION

The invention is a boot fastening device that is particularly well suited for ski boots. The fastening device according to the invention is a device that provides for a very fine adjustment of the tightness with which the boot fits on a user's foot while also being easy to access and operate.

The fastening device has a control means that allows the user to operate the device, an adjustment means that provides for very fine adjustments of the device, and a strap assembly for securing the boot on the user's foot. The conventional ski boot has an opening along one side of the boot, to facilitate getting a foot into or out of the boot, and the strap assembly connects both sides of the opening and allows the user to adjust the fit of the boot against the user's leg.

The control means is accessible to a user and is connected to the adjustment means. One or more magnets are included in the control means, which hold the control means in a desired position to facilitate ease of access. Operating the control means drives the adjustment means, which is connected on the other end to the strap assembly.

The adjustment means includes a gear set that transmits a rotation of the control means into a length adjustment of a threaded adjustment rod that is affixed to the support strap, thereby allowing for a very fine adjustment in the tension on the support strap and the fit of the boot on the skier's foot.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
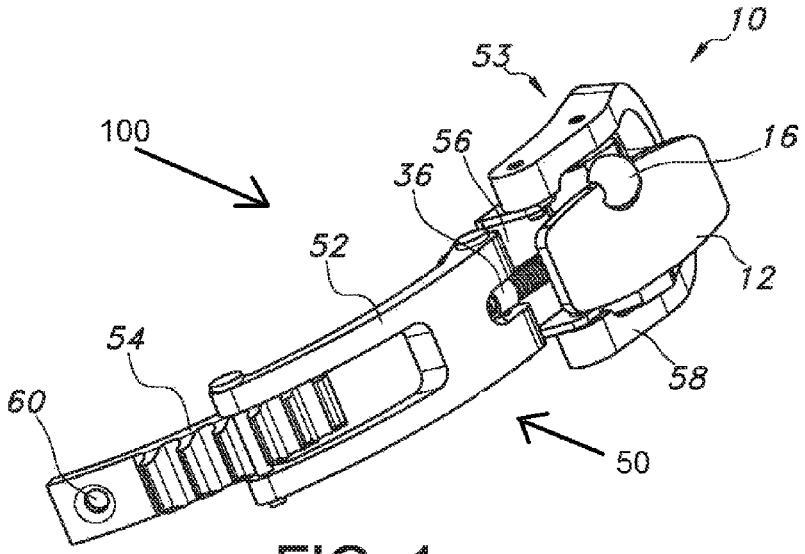
FIG. 1 is a perspective view of the device according to the invention.
Figure 2:
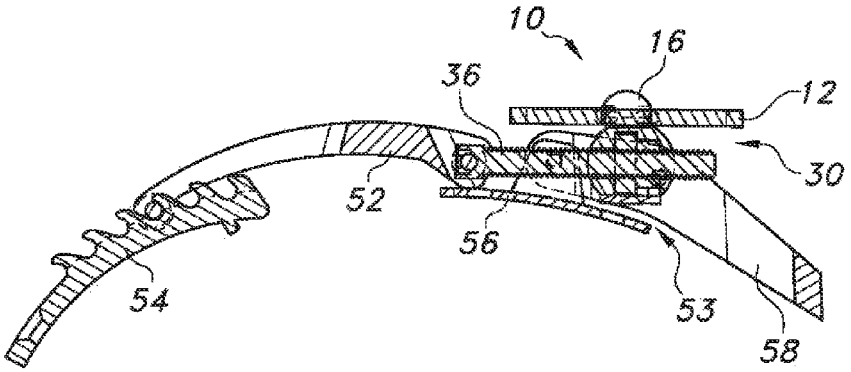
FIG. 2 is a cross-sectional view of the device.
Figure 3:
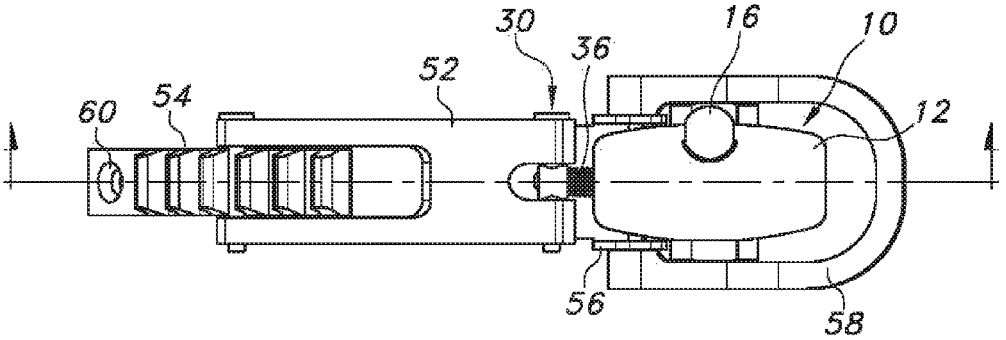
FIG. 3 is a top view of the device.
Figure 4:
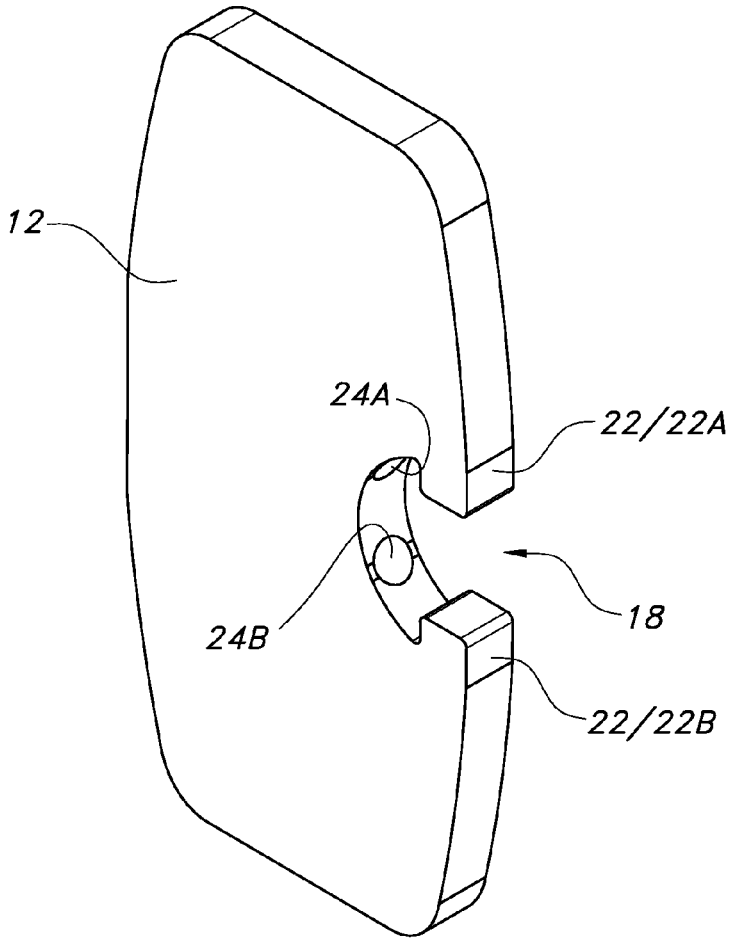
FIG. 4 is a perspective view of the device winder.

FIGS. 1, 2, and 3 illustrate a boot fastener 100 according to the invention that includes a control means 10, an adjustment means 30, and a strap assembly 50 for securing a boot or a shoe, for example (not shown). The fastener 100 is referred to as a "boot" fastener herein, as that was the initial intended application, but it is understood that the fastener 100 may be used to fasten other types of elements. The strap assembly 50 has a buckle catch 54 that is fixedly attached to one side of the opening and a buckle mount 56 that is affixed to the other side of the opening. Attached to the buckle mount 56 is a buckle latch 58 that is hingedly attached to a buckle pawl 52. The buckle catch 54 has a series of ratchet protrusions that form a series of recesses and the buckle pawl 52 is manually movable by the user to a desired one of the recesses, as a way of adjusting the overall length of the strap assembly 50.

The control means 10 has a winder 12 that is accessible to a user while wearing the boot. Manipulating the winder 12 while the strap assembly 50 is secured causes the adjustment means 30 to further tighten or loosen the strap assembly 50, depending on the direction of the manipulation. This provides for a finer adjustment of the boot fastener 100 than is possible with existing fasteners.

FIGS. 4-7 illustrate details of the control means. The winder 12 includes an attachment means 22 for coupling the winder to other components of the control means 10. In the embodiment shown, the attachment means 22 includes an open slot 18 that is bounded on its open side by attachment prongs 22A and 22B.

Figure 5:
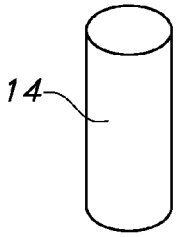
FIG. 5 is a perspective view of the magnet.

The control means 10 also includes one or more magnets 14, shown in FIG. 5, that serve to hold the winder in the position it is left in when the user lets go of it, thereby facilitating easy access to the control means 10 should the skier wish to make further adjustments. Magnet inlets 24, corresponding in number to the number of magnets 14 used, are also provided in the winder 12. In the embodiment shown, the winder 12 is a solid component with the magnet inlets 24A and 24B formed in the solid material. Two magnets 14 and two inlets 24A and 24B are provided in this embodiment of the winder 12. The magnets 14 are inserted into the winder 12 through the inlets 24A/B, although it is understood that other methods may be used to provide the magnets 24 on the winder 12.

FIG. 5 illustrates a neodymium magnet 14, which has a particularly strong magnetic pull, relative the mass of the material of the magnet. The high strength and small size of this type of magnet make it possible to use a magnet that is small enough to be incorporated into the winder 12, without encumbering the design or size of the boot fastener 100, yet strong enough to hold the winder 12 in the position it is left in when the user is finished manipulating it.

Figure 6:
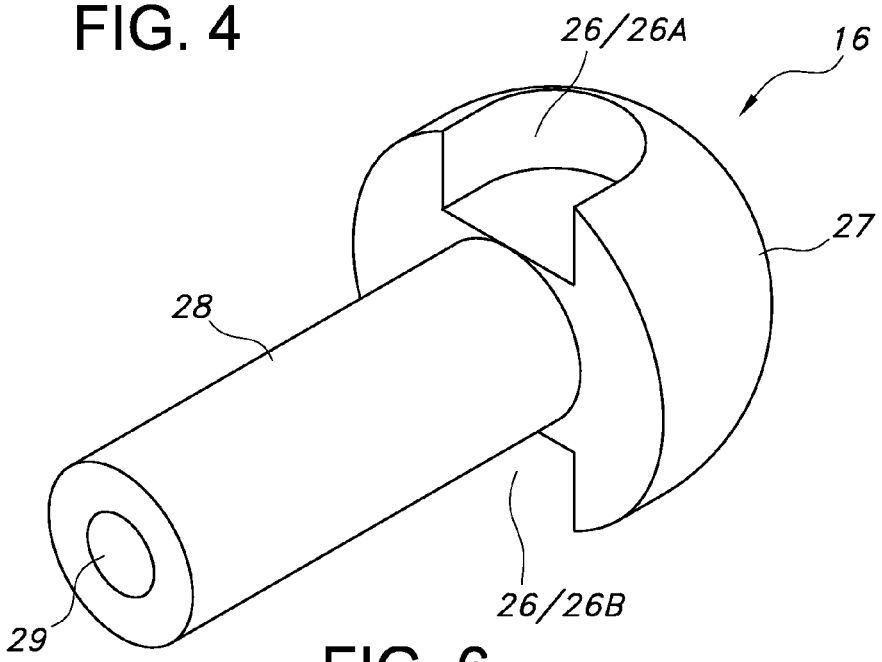
FIG. 6 is a perspective view of the drive control.

FIG. 6 Illustrates a drive control 16 that includes a head 27, a drive shaft 28, and coupling means 26 for coupling the drive control 16 to the winder 12. In the particular embodiment shown in the figures, the coupling means 26 includes recesses 26A, 26B. The head 27 is dimensioned to fit within the open slot 18 in the winder 12, such that the attachments means 22, which, in the embodiment shown includes two prongs that snap into corresponding recesses 26A and 26B on the drive control 16.

Figure 7:
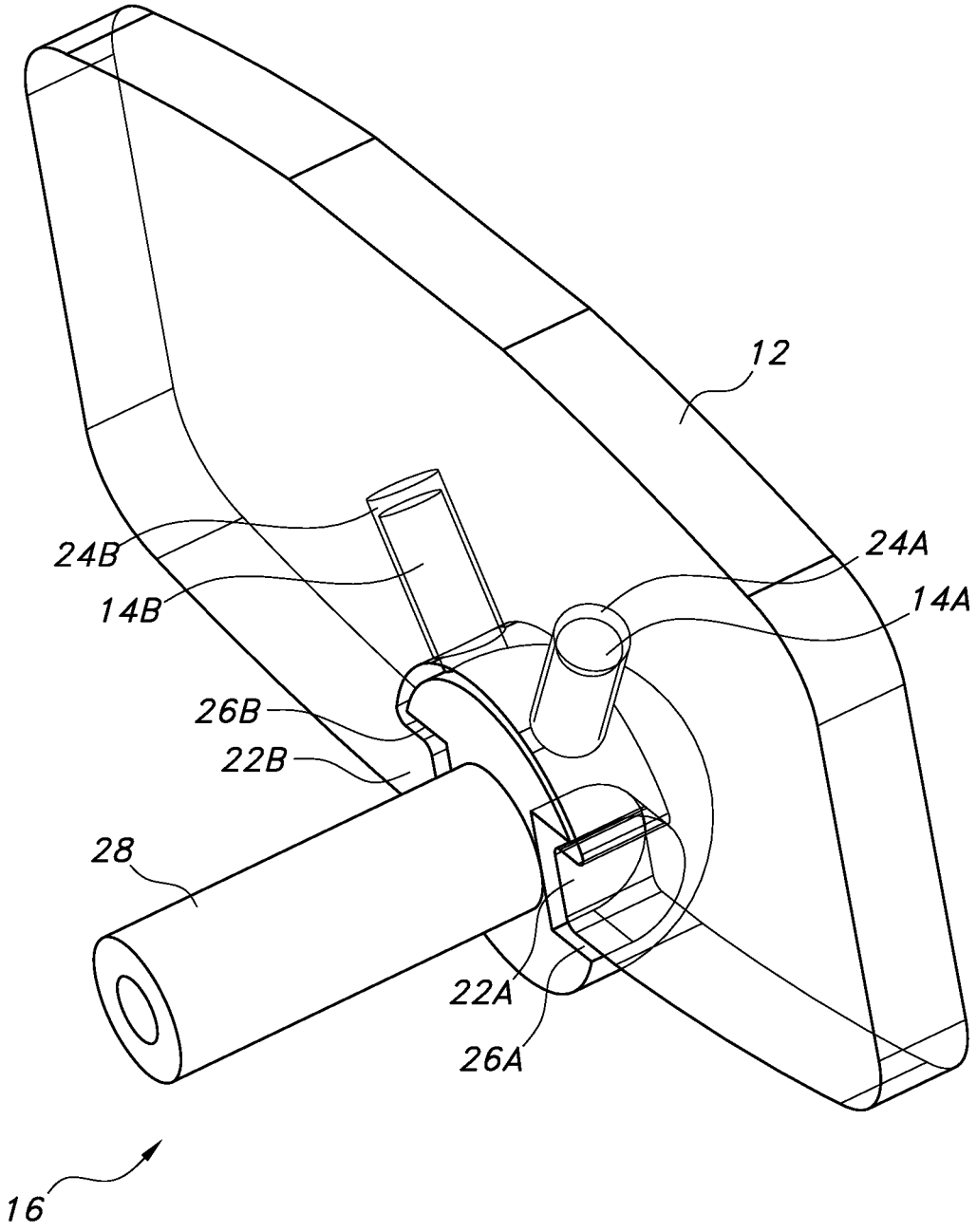
FIG. 7 is a perspective view of the control means and magnets.
Figure 8:
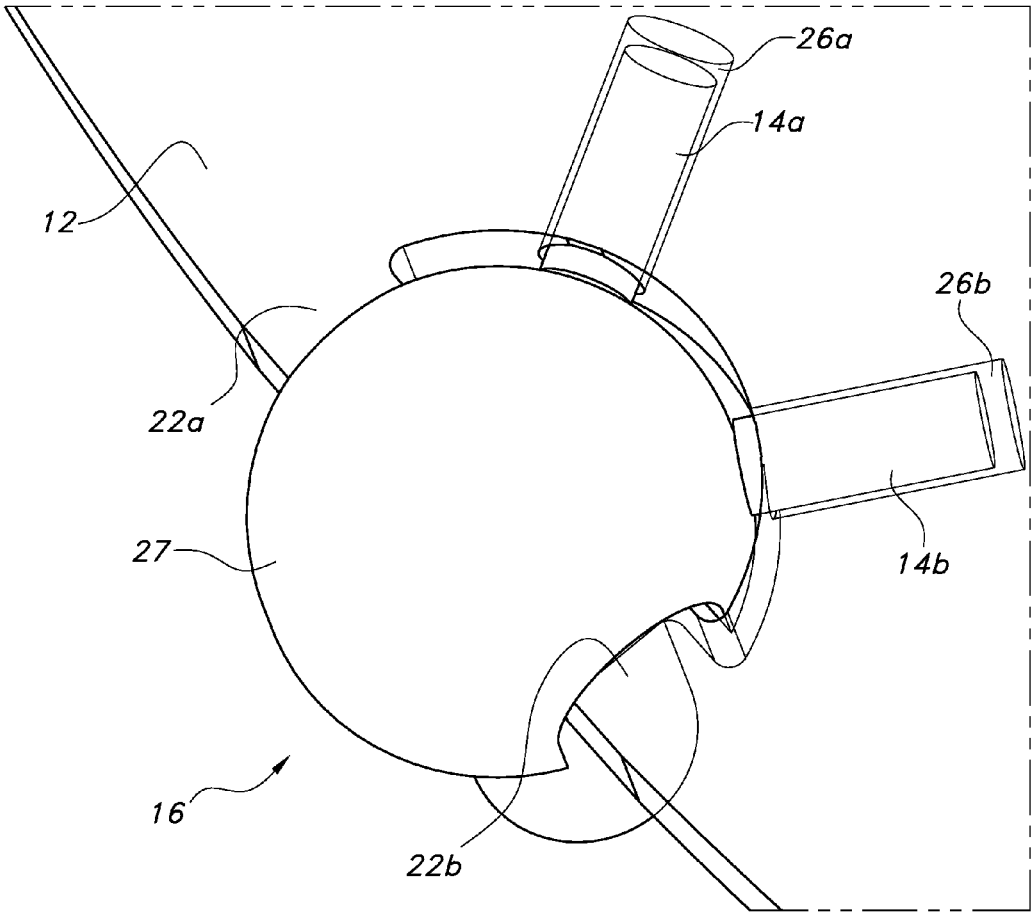
FIG. 8 is a top view of the control means and magnets.

FIG. 7 illustrates a specific embodiment of the control means 10, showing the winder 12, which serves as a housing for two magnets 14A, 14B, coupled to the drive shaft 16. FIG. 8 shows the same construction in a top plan view. There may be other suitable ways for coupling the winder 12 with the drive control 16 so that the winder 12 may be readily grasped by the wearer and manipulated, and it is understood that the description of this embodiment is not intended to limit the scope of protection to this embodiment. The assembly with the attachment means 22 and the recesses 26A and 26B allows the winder 12 to rotate about the head 27. The drive shaft 28 extends down into the adjustment means 30.

Figure 9:
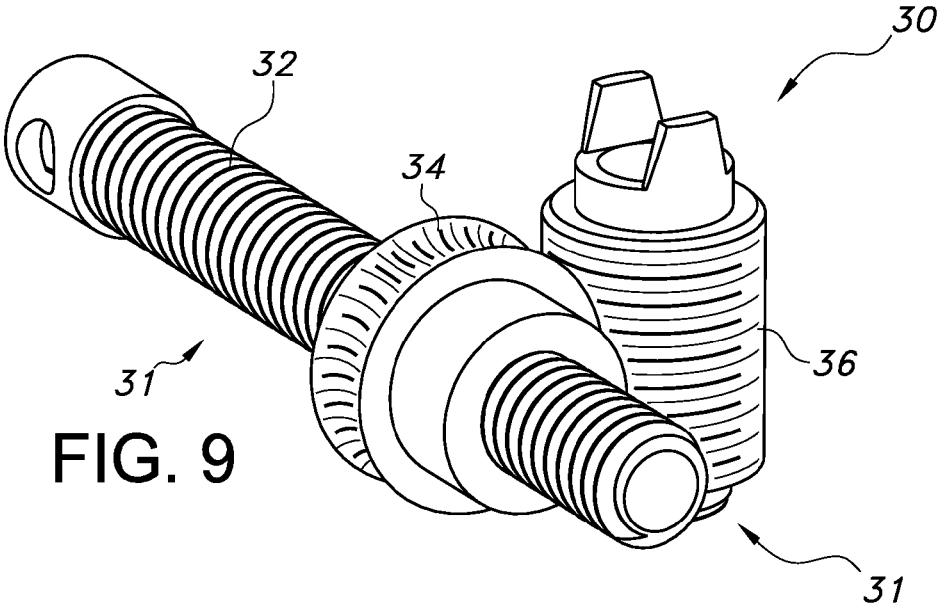
FIG. 9 is a perspective view of the adjustment means.
Figure 10:
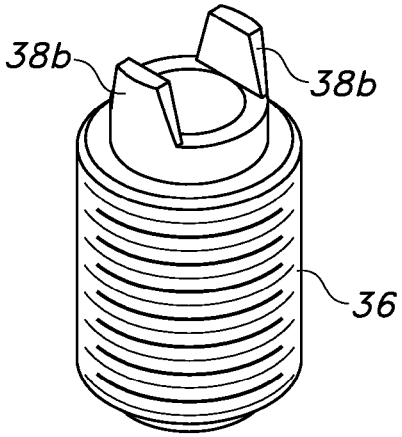
FIG. 10 is a perspective view of the worm wheel.
Figure 11:
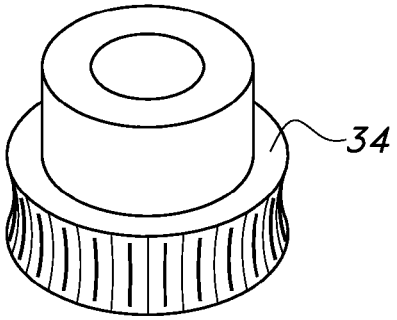
FIG. 11 is a perspective view of the worm gear.
Figure 12:
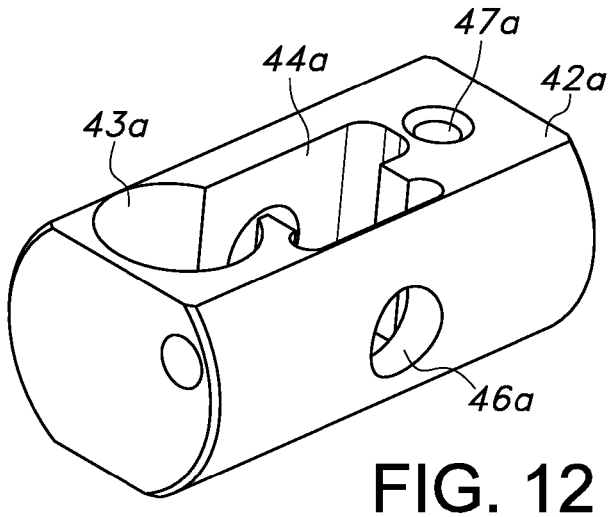
FIG. 12 is a perspective view of the left drive tube.
Figure 13:
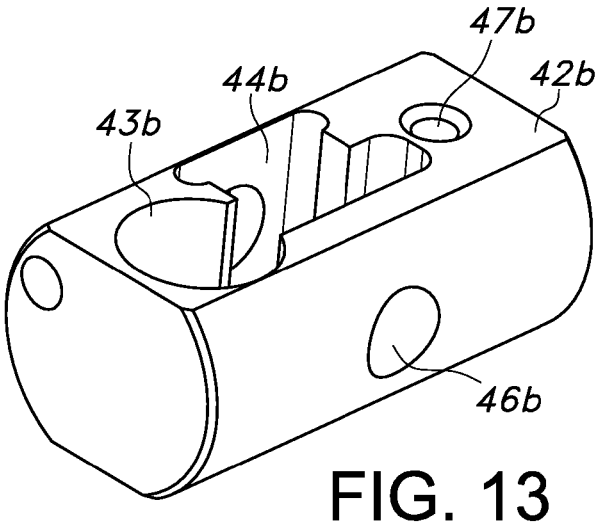
FIG. 13 is a perspective view of the right drive tube.
Figure 14:
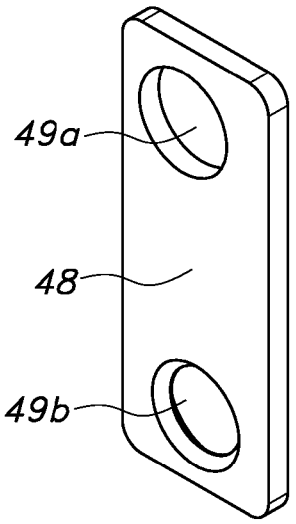
FIG. 14 is a perspective view of the drive tube cover.

FIG. 9 illustrates the adjustment means 30, which is coupled to the control means 10 at one end and connected to the buckle pawl 52 (shown in FIGS. 1-3 and 16) of the strap assembly 50 at the other end. The adjustment means 30 includes a gear set 31, comprising a worm wheel 36 and a worm gear 34, and transmits a rotation of the control means 10 into a length adjustment of a threaded adjustment rod 32 that is affixed to the buckle pawl 52. Gear sets are well known and the gear teeth are shown in the figures merely schematically.

FIGS. 10-14 illustrate details of the various components of the adjustment means 30, including the components of the gear set 31, gear tubes 42A, 42B, and a gear tube cover 48.

Figure 15:
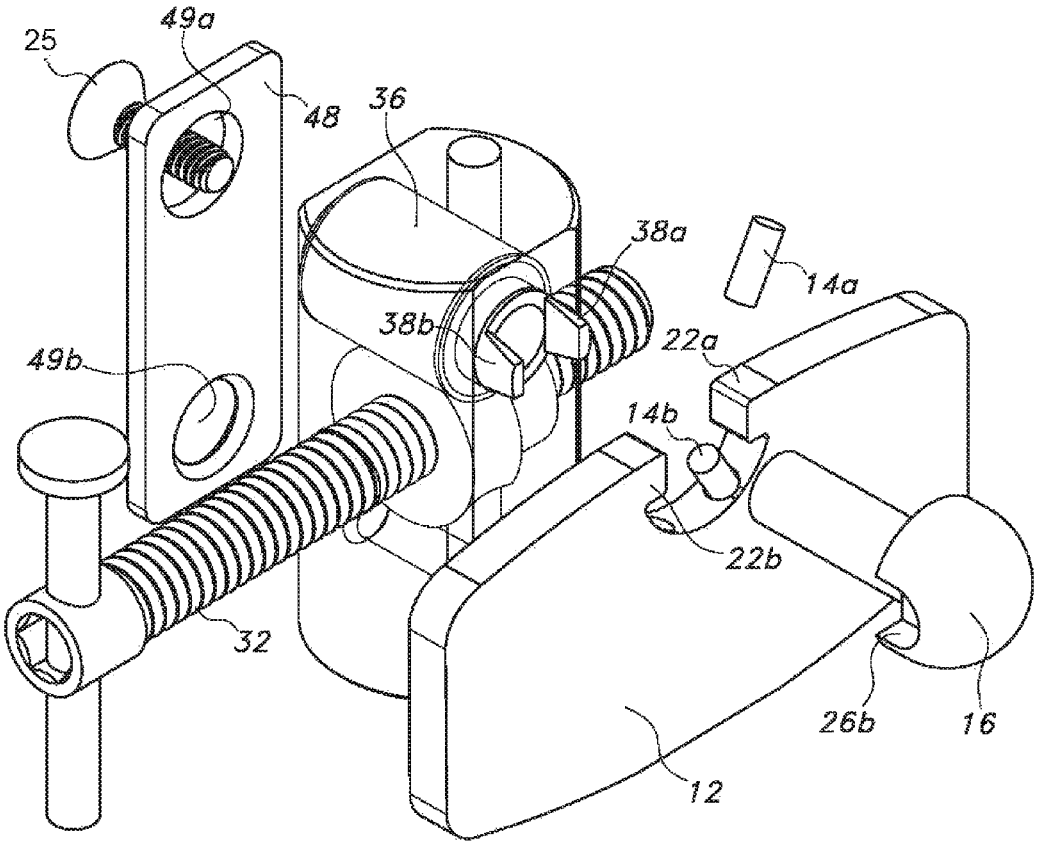
FIG. 15 is an exploded view of the control means and the adjustment means.
Figure 16:
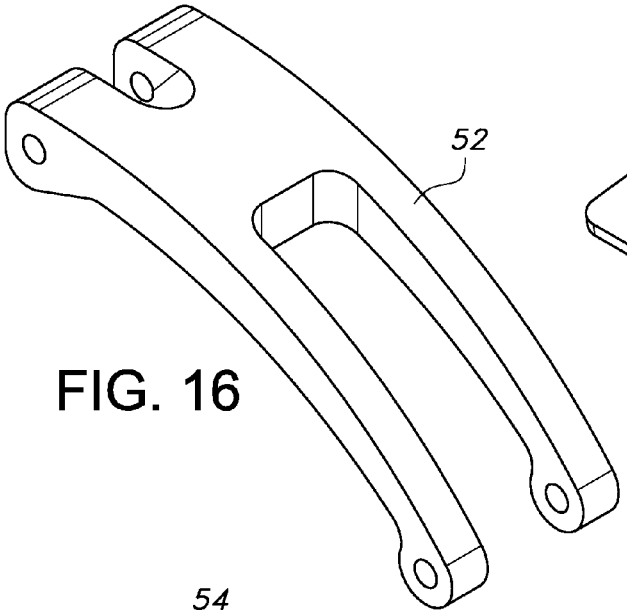
FIG. 16 is a perspective view of the buckle pawl.
Figure 18:
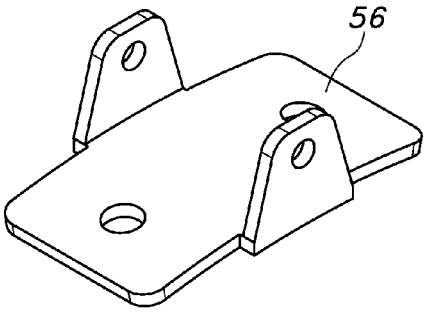
FIG. 18 is a perspective view of the buckle mount.
Figure 17:
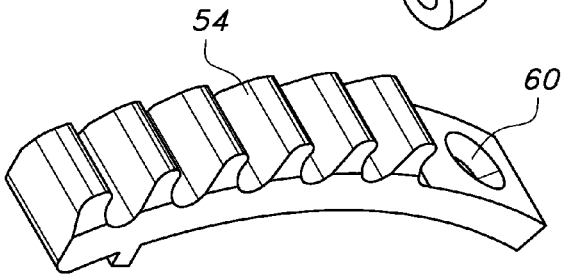
FIG. 17 is a perspective view of the buckle catch.
Figure 19:
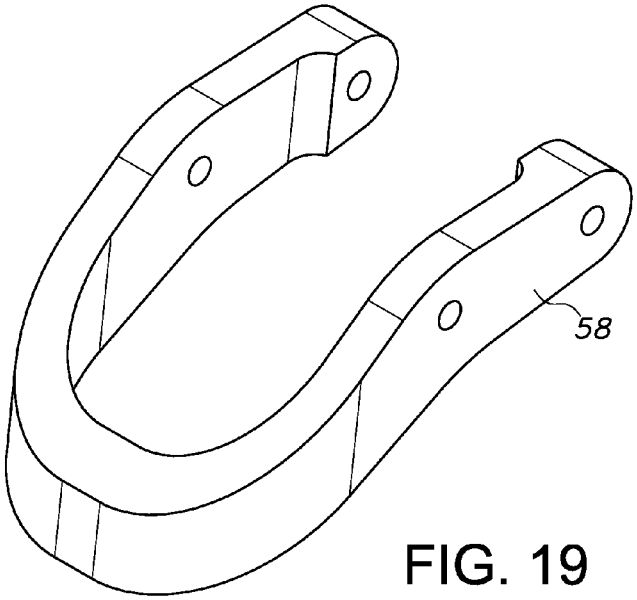
FIG. 19 is a perspective view of the buckle latch.

FIG. 15 is an exploded view that illustrates how the control means 10 and the adjustment means 30 are assembled. The individual gears are shown schematically in this figure and the gear teeth have been omitted, but it is understood that the gears mesh as shown in FIG. 9. The worm wheel 36 has a cylindrical bore into which the drive shaft 28 is inserted. Worm wheel ears 38A, 38B are inserted into drive control 16 recesses 26A, 26B before the winder prongs 22 are snapped into place. The worm wheel 36 and worm gear 34 are assembled in a gear tube assembly 40 that includes a first gear tube 42A, a second gear tube 42B, and a gear tube cover 48. The drive shaft 28 has a threaded bore 29, shown in FIG. 6, into which a threaded fastener 25 is inserted to further secure the control means 10 to the adjustment means 30.

Each gear tube 42A, 42B includes a first chamber 43, a second chamber 44, and a tube hole 46. The gear tube cover 48 attaches to the first and second gear tubes 42A, 42B by threaded fasteners 25 which are inserted through holes 47A, 49A and 47B and 49B. The worm wheel 36 fits into the first chamber 43, the worm gear 34 fits into the second chamber 44, and the adjustment rod 32 passes through first and second gear tubes through tube holes 46A, 46B.

FIG. 15 is an exploded view that shows the assembly of the control means 10 with the winder 12, two rare-earth magnets 14A, 14B, and the drive control 16. The magnets 14A, 14B are inserted into the winder 12. Rotation of the drive control 16 causes the worm wheel 36 to rotate and travel along the worm gear 34, which turns the adjustment rod 32. As the worm wheel 34 rotates, the adjustment rod 32 is pushed or pulled, depending on the direction of rotation of the worm wheel. As a result, the buckle pawl 52, shown in FIGS. 1-3 and 16, is pulled closer or pushed away from the buckle catch 54, thereby loosening or tightening the boot depending on the direction of rotation.

Referring again to FIGS. 1-3 and 16-19, the strap assembly 50 includes the buckle pawl 52, the buckle catch 54, buckle mount 56 and a buckle latch 58. The buckle mount 56 secures the buckle latch 58 to the boot. The buckle catch 54 is attached directly to the boot by a screw through buckle catch hole 60. When the buckle latch 58 is in the open position the buckle pawl 52 is movable towards the buckle catch 54 and is attachable to the buckle catch 54 in relatively wide units. The latch 56 secures or releases the buckle pawl 52 to or from the buckle catch 54. The adjustment rod 32 is fixedly connected to the buckle pawl 52 and manipulating the control means 10 enables a continuous, fine-adjustment of the strap assembly 50.

It is understood that the embodiments described herein are merely illustrative of the present invention. Variations in the construction of the fastening device may be contemplated by one skilled in the art without limiting the intended scope of the invention herein disclosed and as defined by the following claims.

What is claimed is:

1. A boot fastening device, the device comprising:

a control means that is operatable by a user and that includes one or more rare-earth magnets that cause the control means to maintain a last-released position until re-positioned;

an adjustment means that is coupled to and controllable by the control means and that includes a gear set and a threaded adjustment rod; and a strap assembly that is fixedly attached to the adjustment means on one end and attachable to a boot on an opposite end;

wherein operating the control means actuates the gear set in the adjustment means, thereby selectively pushing and pulling the adjustment rod, so as to finely adjust the strap assembly.

2. The boot fastening device of claim 1, wherein the control means includes a winder and a drive shaft that are coupled to the adjustment means.

3. A boot fastening device, the device comprising:

a control means that is operatable by a user;

an adjustment means that is coupled to and controllable by the control means; and a strap assembly that is fixedly attached to the adjustment means on one end and attachable to a boot on an opposite end;

wherein the control means includes a winder and a drive shaft and one or more rare-earth magnets provided in close proximity to the winder and that cause the winder to maintain its position.

* * * * *